US006085675A

United States Patent [19]

Kawasato et al.

[11] Patent Number: 6,085,675

[45] Date of Patent: Jul. 11, 2000

[54] DEVICE FOR PRODUCING EMBROIDERY DATA ON THE BASIS OF IMAGE DATA

[75] Inventors: Takayuki Kawasato; Shinichi Fuchigami; Haruhiko Tanaka, all of Tokyo, Japan

[73] Assignee: Janome Sewing Machine Co., Ltd., Tokyo, Japan

[21] Appl. No.: 08/804,939

[22] Filed: Feb. 24, 1997

[30] Foreign Application Priority Data

Apr. 26, 1996 [JP] Japan ..... 8-130926

[51] Int. Cl.[7] ..... D05C 5/06

[52] U.S. Cl. ..... 112/102.5; 364/470.09

[58] Field of Search ..... 112/102.5, 470.06, 112/470.04, 475.19, 454, 456, 458; 364/470.09

[56] References Cited

U.S. PATENT DOCUMENTS 5,151,863 9/1992 Komuro et al. ..... 112/102.5 X 5,499,589 3/1996 Kyuno et al. ..... 112/102.5

5,560,306 10/1996 Kyuno et al. ..... 112/102.5

*Primary Examiner*—Peter Nerbun

*Attorney, Agent, or Firm*—Michael J. Striker

[57] ABSTRACT

Disclosed is a device for producing embroidery data on the basis of image data, wherein jump threads extended between unit images are effectively prevented from being stitched into the embroidery stitches by using particular stitch data produced by successively searching the image data from above to set a stitch starting point of each unit image. The stitch data forms the stitches starting from the stitch starting point and terminating at the stitch starting point. Although the jump threads are produced between the stitch starting points, these jump threads will not be stitched into the embroidery stitches.

4 Claims, 3 Drawing Sheets

DEVICE FOR PRODUCING EMBROIDERY DATA ON THE BASIS OF IMAGE DATA

BACKGROUND OF THE INVENTION AND RELATER ART STATEMENT

The present invention relates to an embroidery data producing device and more particularly relates to a device for producing embroidery stitch data on the basis of an original image to be stitched by use of a sewing machine.

So far the pattern data used in connection with a sewing machine capable of embroidery stitching and an embroidering machine for exclusively stitching embroidery patterns have been provided by a sewing machine maker, and the user has normally operated the sewing machine by use of the pattern data supplied by the machine maker to enjoy embroidery stitching.

However with the recent wide spread of personal computers, the user has come to have a desire to make patterns by herself and to use the pattern data for stitching her own embroidery patterns. Moreover a device for reading the images with an image sensor to make the image data from the images may now be easily available in the market. Actually such a device is now an accessory attached to a sewing machine for sale.

In case the user makes original images as she please to produce the stitch data thereof for embroidery stitching, it becomes problematical to deal with the so called jump threads which connect the individual patterns composing the image. It, therefore, becomes necessary to produce the stitch data which will reduce the jump threads as much as possible and also to avoid the jump threads to be stitched into the patterns.

The maker could produce the stitch data in consideration of such problems. However for the user who employs the stitch data producing device available in the market, it is impossible to produce the appropriate stitch data because such a device will automatically convert the original image into the stitch data literally as it is. This has required the user to deal with many jump threads after the embroidery stitching has been finished.

Indeed the jump threads will abundantly emerge especially when the stitch data are produced from the framework data of the images such as the characters or other outline patterns. Such jump threads will be often stitched into the characters or the patterns to be embroidered. This has been a big problem for the machine user.

The present invention has been provided in consideration of such problem, and it is a principal object of the invention to provide an embroidery data producing device for avoiding the jump threads to be stitched into the embroidered images.

SUMMARY OF THE INVENTION

For attaining the above mentioned object, the embroidery data producing device of the present invention substantially comprises means for giving a plurality of unit images, means for searching the unit images from a particular direction, the searching means setting a first searched position of a unit image as the stitch starting point of the unit images and means for producing stitch data of the unit images for enabling stitches to be started from and ended at the first searched position of the unit image, the stitch data being controlled to make the stitches for forming the unit images individually and successively from the particular direction.

Each of the unit images has an apex point in a particular direction from which the stitches are started and ended thereat. Since the stitches are formed successively in the particular direction, the jump threads between the unit images always follow the initial stitch of the next unit image to be stitched. Therefore the jump threads will not be stitched into any of the unit images.

In order to terminate the stitches at the starting point of the unit image, it is preferable to perform double stitching, e.g. to performing zigzag stitching after the straight stitching has been performed. Such double stitching may be performed with the zigzag stitches of different amplitudes. This type of double stitching is especially appropriate for the images such as the characters and other outline patterns because the embroidered images will be effectively so solid. Further it may take the so called mode of one stroke stitching depending on the type of images.

The embroidery data producing device of the invention may be a single independent device or may be incorporated in the embroidery sewing machine or may be partly independent and partly incorporated in the sewing machine.

DETAILED DESCRIPTION OF A PREFERRED EMBODIMENT

Figure 1:
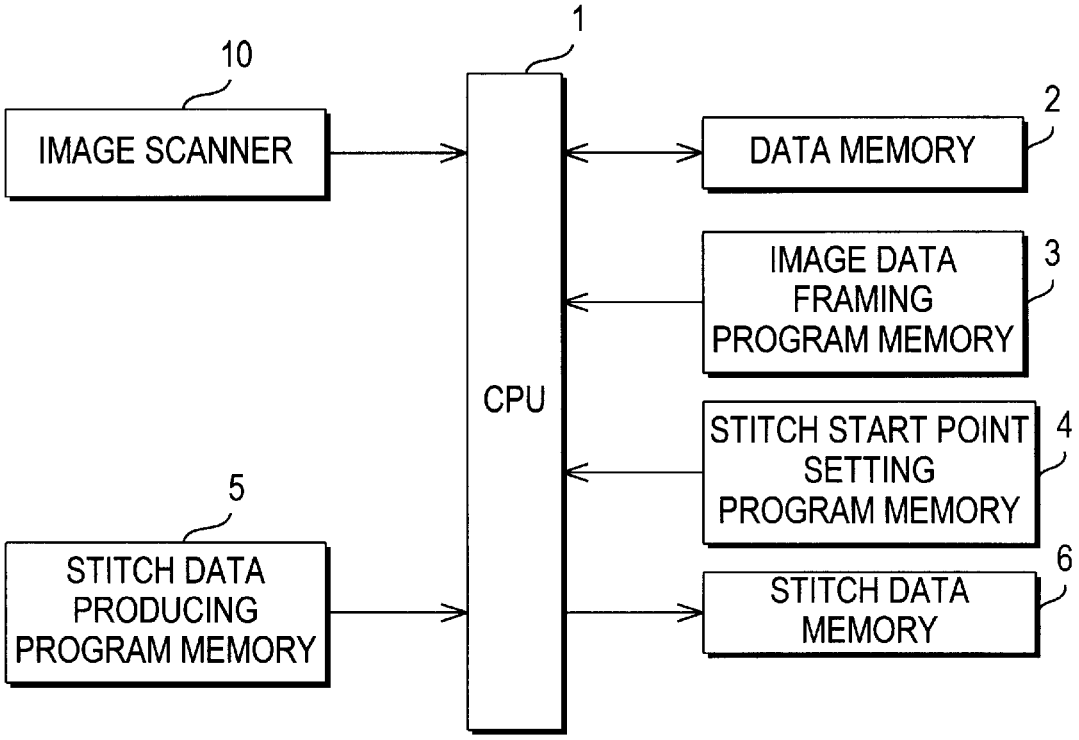
FIG. 1 is a block diagram showing a substantial structure of an embodiment according to the invention.

The invention will now be described in reference to the embodiment as shown in the attached drawings. In FIG. 1, the embodiment comprises a microcomputer including a CPU 1.

The CPU 1 has an image scanner 10 connected thereto for enabling the user to operate the image scanner 10 to read a desired image and input the image data into the CPU 1. The image data is once stored in a data memory 2 connected to the CPU 1.

The data memory 2 may be replaced, e.g. by a memory medium such as a memory card having the image data stored therein or by an image processing device such as a CAD so that these components may be appropriately connected to the CPU 1.

In this embodiment, the CPU 1 will read and digitize the image data under the control of an image data framing program stored in an image data framing program memory 3, thereby to frame the image to be stitched.

The way for converting the image data into frame data may be any of the conventional ones as generally known. However normally the data framing is performed by searching the center line or the contour line of the image. The frame data is also stored in the data memory 2. The frame data of the center line can be obtained by a thinning or skeletonizing procedure of the image, while the frame data related to the contour line can be obtained by a digital boundary determination, as disclosed for example in chapter 8 of the publication "Image Processing on Personal Computer" written by Rafael C. Gonzalez and Richard E. Woods, published by ADDISON-WESLEY PUBLISHING COMPANY on September, 1993, which is incorporated here by reference.

The CPU 1 will produce the stitch data on the basis of the frame data and under the control of the programs stored in a stitch start point setting program memory 4 and in a stitch data producing program memory 5 respectively. The stitch data is stored in a stitch data memory 6. The stitch data memory medium 6 is mounted on the sewing machine where the embroidery stitching is performed.

Figure 3:
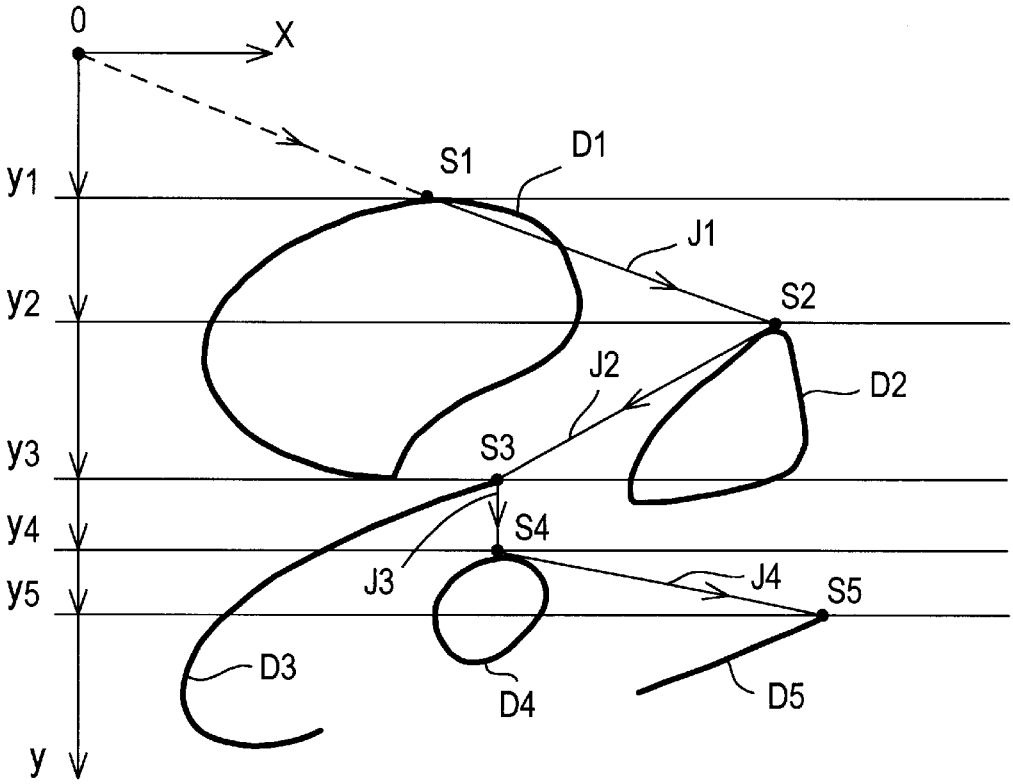
FIG. 3 is an illustration showing the operation of the embodiment.

The way for producing the stitch data will now be described in reference to FIG. 3 in which the frame data D1~D5 are shown for the unit images in connection with the x-y coordinates. In this FIG. D1, D2, and D4 are of the contour lines of the original image, while D3 and D5 are the center lines. The search is performed successively in the direction of the y axis from the x axis in accordance with the stitch start point setting program stored in the memory 4. A point where the first frame data exists, i.e. the apex point S1 in the direction of the y axis is set as the stitch starting point. Then the stitch data is produced in accordance with the stitch data producing program stored in the memory 5, the stitch data forming the stitches starting from the stitch starting point S1 and terminating at the stitch starting point S1. In the same way, the next stitch starting point S2 may be set for the next unit image D2 below in the direction of the y axis and the stitch data is produced, which will form the stitches starting from the stitch starting point S2 and terminating at the point S2. Similarly the stitch data may be produced for the following unit images D3, D4 and D5 in succession.

In this embodiment, the stitch data is such that a first set of stitches will be formed in one direction and a second set of stitches will be formed along a same route in an opposite direction. More precisely if the unit image is linear such as the unit image D3 or D5, the stitches will start from the starting point S3 or S5 and come to the end of the unit image and then return to the starting point S3 or S5. Such double stitching will be effective for making the embroidered unit images as a solid. The first stitching may be straight stitches or zigzag stitches of relatively small amplitude. The second stitching however comprises the zigzag stitches which are of an amplitude larger than that of the precededly formed zigzag stitches.

The stitch data is produced individually for each of the unit images so as to perform stitching of the unit images successively in the same direction as the search was performed to detect the stitch starting points S.

The thus produced stitch data will produce the jump threads J1~J4, e.g. between the points S1 and S2, between the points S2 and S3, between the points S3 and S4 and between the points S4 and S5. These jump threads however will not be stitched into the embroidery stitches. Although the jump thread J1 actually crosses the stitches of the unit image D1, the jump thread will not be stitched into the embroidery stitches of the image because the jump thread is produced after the image D1 has been finished. Further since the jump thread J1 is connected to the apex point S2 of the next unit image D2, the jump thread J1 will not be stitched into the embroidery stitches of the unit image D2. This is the same with respect to the other jump threads. Thus the jump threads will be effectively prevented from being stitched into the embroidery stitches of the unit images which are stitched in succession.

Figure 2:
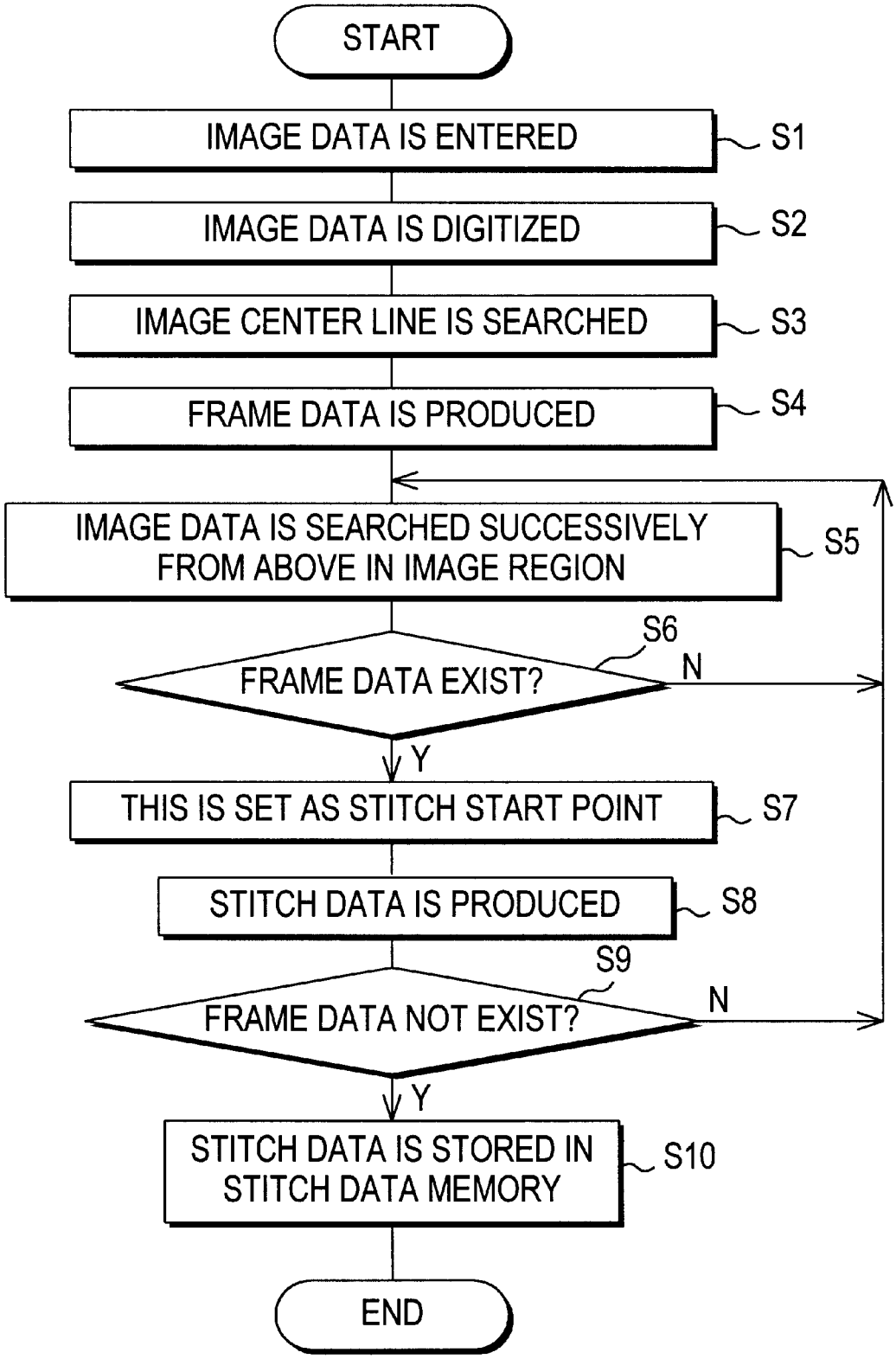
FIG. 2 is a flow chart showing the operation of the embodiment.

The operation of the above mentioned stitch data producing will be described in reference to the flow chart of FIG. 2.

The image data is entered (step S1). The image data is digitized (step S2). The center line of each unit image is searched to produce the frame data (steps S3 and S4).

Then the frame data is searched successively from the above in the region of the unit images (steps S5 and S6). The first searched frame data is set as the stitch starting point (step S7). Then the stitch data is produced on the basis of the frame data (step S8), the stitch data forming the stitches starting from the stitch starting point and coming to the end of the unit image and then returning to the stitch starting point.

The operations as mentioned above are continued until the frame data disappears (step S9). After all the frame data have been converted into the stitch data, the stitch data is stored in the stitch data memory 6 (step S10). The thus produced stitch data is employed as the embroidery data.

As is apparent from the description in reference to the embodiment as mentioned above, the device for producing the embroidery data on the basis of the image data according to the invention is very effective for producing the embroidery data from a plurality of unit images, the embroidery data forming the embroidery stitches for effectively preventing the jump threads from being stitched into the embroidery stitches.

What is claimed is:

1. A device for producing embroidery data on the basis of image data, said device comprising means from which image data is obtained and representing a plurality of unit images; means for searching said unit images from a particular direction and setting a first searched position of said unit images as a stitch starting point; means for producing stitch data which form stitches individually for each of said unit images so that said unit images may be stitched successively beginning at a stitch starting point and progressing in a particular direction; and means for converting said image data into frame data for framing said unit images, wherein said stitch data producing means produces said stitch data on the basis of said frame data.

2. The device as defined in claim 1 wherein said stitch data forms stitches which start from said stitch starting point to the end of each unit image and return to said stitch starting point again.

3. A device for producing embroidery data on the basis of image data, said device comprising means from which image data is obtained and representing a plurality of unit images; means for searching said unit images from a particular direction and setting a first searched position of said unit images as a stitch starting point; means for producing stitch data which form stitches individually for each of said unit images so that said unit images may be stitched successively beginning at a stitch starting point and progressing in a particular direction; and means for converting said image data into frame data for framing said unit images, wherein said stitch data producing means produces said stitch data on the basis of said frame data, said stitch data producing means forming stitches for stitching along a same route, so that a first stitching is performed with straight stitches and a second stitching is performed with zig zag stitches.

4. A device for producing embroidery data on the basis of image data, said device comprising means from which images data is obtained and representing a plurality of unit images; means for searching said unit images from a particular direction and setting a first searched position of said unit images as a stitch starting point, means for producing stitch data which form stitches individually for each of said unit images so that said unit images may be stitched successively beginning at a stitch starting point and progressing in a particular direction; and means for converting said image data into frame data for framing said unit images, wherein said stitch data producing means produces said stitch data on the basis of said frame data, said stitch data producing means forming stitches for stitching along a same route, a first stitching being performed with first zig zag stitches and a second stitching being performed with zig zag stitches having an amplitude larger than that of the first zig zag stitches.

* * * * *